US009518792B1

(12) United States Patent
Huang

(10) Patent No.: US 9,518,792 B1
(45) Date of Patent: Dec. 13, 2016

(54) ENHANCED MAGAZINE RELEASE BUTTON ASSEMBLY

(71) Applicant: George Huang, Henderson, NV (US)

(72) Inventor: George Huang, Henderson, NV (US)

( * ) Notice: Subject to any disclaimer, the term of this patent is extended or adjusted under 35 U.S.C. 154(b) by 0 days.

(21) Appl. No.: 14/561,209

(22) Filed: Dec. 4, 2014

(51) Int. Cl.
*F41A 35/00* (2006.01)
*F41C 27/00* (2006.01)
*F41A 17/38* (2006.01)

(52) U.S. Cl.
CPC ..... *F41A 17/38* (2013.01); *F41A 35/00* (2013.01); *F41C 27/00* (2013.01)

(58) Field of Classification Search
CPC ..... F41A 29/00; F41A 35/00; F41A 11/00; F41A 17/56; F41A 17/64; F41A 17/74; F41A 19/11; F41A 35/06; F41A 3/66; F41A 17/38; F41C 27/00; F41G 1/545
USPC ..... 42/6
See application file for complete search history.

(56) References Cited

U.S. PATENT DOCUMENTS

| | | | | |
|---|---|---|---|---|
| 4,638,581 | A * | 1/1987 | Moore | F41A 35/06 42/7 |
| 6,141,895 | A * | 11/2000 | Rost et al. | F41A 35/06 42/6 |
| 7,921,587 | B2 * | 4/2011 | Mayberry | F41A 21/481 42/49.01 |
| 8,112,926 | B2 * | 2/2012 | Gussalli | F41A 17/38 42/6 |
| 8,276,502 | B1 * | 10/2012 | Wright | F41A 17/46 42/70.01 |
| 8,572,875 | B2 * | 11/2013 | Sisgold | F41A 9/66 42/1.02 |
| 8,806,790 | B1 * | 8/2014 | Huang et al. | F41A 17/74 42/70.08 |
| 9,010,004 | B1 * | 4/2015 | Fu | F41A 17/38 42/49.01 |
| 2010/0263252 | A1 * | 10/2010 | Strayer | F41A 35/06 42/7 |

* cited by examiner

*Primary Examiner* — Jonathan C Weber
(74) *Attorney, Agent, or Firm* — Shaddock Law Group, PC

(57) ABSTRACT

An enhanced magazine release button assembly having a button member, wherein the button member includes a projection formed on an end of the button member; and a finger pad member, wherein the finger pad member includes a recess mateable with the projection of the button member, wherein the finger pad member is secured to the end of the button member via interaction of the projection and the recess and is further secured to the end of the button member via a fastener.

20 Claims, 23 Drawing Sheets

ENHANCED MAGAZINE RELEASE BUTTON ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to an enhanced magazine release button assembly adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms 10, as illustrated in FIG. 1, include a push-button magazine release found on one side of the firearm. Off times, as further illustrated in FIGS. 1-4, the magazine release button 11 is at least partially protected by one or more ridges that reduce the chances of inadvertent activation.

The magazine release button 11 typically includes an internal, aperture 12 that extends through the entire magazine release button 11. The magazine release mechanism typically includes a magazine release button 11 that is coupled to a magazine release 20, which includes a magazine engagement projection 23 that releasably engages a portion of a magazine, when fully inserted within the magazine well of the firearm 10.

The magazine release 20 includes a magazine release connection shaft 21 that extends from one side of the magazine release. The magazine release connection shaft 21 includes a threaded portion 22 that can be threaded late engaged with the aperture 12 of the magazine release button 11.

A magazine release spring 15 typically provides spring biasing to the magazine release lever 11, when installed in the firearm 10.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical magazine release button arrangement has various disadvantages and shortcomings. The disadvantages and shortcomings of the prior art are overcome by the features and elements of the enhanced magazine release button assembly of the present invention. The advantages of the present invention are preferably attained by providing an enhanced magazine release button assembly that comprises a button member and a finger pad member. The finger pad member is slidably, releasably attached to the button member so as to provide a more ergonomic magazine release button that provides more surface area and is more functional for user.

In various exemplary, non-limiting embodiments, the present invention comprises an enhanced magazine release button assembly having a button member, wherein the button member includes a projection formed on an end of the button member; and a finger pad member, wherein the finger pad member includes a recess mateable with the projection of the button member, wherein the finger pad member is secured to the end of the button member via interaction of the projection and the recess and is further secured to the end of the button member via a fastener.

In other exemplary, non-limiting embodiments, the present invention comprises an enhanced magazine release button assembly having a button member, wherein the button member includes a primary threaded aperture formed through the button member and a secondary aperture formed at least partially through the button member, wherein the secondary aperture is formed at a distance spaced apart from the primary threaded aperture, and wherein the button member includes a projection formed on an end of the button member; and a finger pad member, wherein the finger pad member includes a recess mateable with the projection of the button member, wherein the finger pad member further comprises a finger pad member aperture formed therethrough, wherein when the finger pad member is secured to the end of the button member, via interaction of the projection and the recess, the finger pad member aperture aligns with the secondary aperture, such that the finger pad member may be further secured to the end of the button member via a fastener secured through the finger pad member aperture and the secondary aperture.

In still other exemplary, non-limiting embodiments, the present invention comprises an enhanced magazine release button assembly having a button member, wherein the button member includes a primary threaded aperture formed through the button member and a secondary aperture formed at least partially through the button member, wherein the secondary aperture is formed at a distance spaced apart from the primary threaded aperture, and wherein the button member includes a dovetail projection formed on an end of the button member; and a finger pad member, wherein the finger pad member includes a dovetail recess mateable with the projection of the button member, wherein the finger pad member further comprises a finger pad member aperture formed therethrough, wherein when the finger pad member is secured to the end of the button member, via interaction of the dovetail projection and the dovetail recess, the finger pad member aperture aligns with the secondary aperture, such that the finger pad member may be further secured to the end of the button member via a fastener secured through the finger pad member aperture and the secondary aperture.

Accordingly, the presently disclosed invention separately provides improved magazine release buttons for firearms.

The presently disclosed invention separately provides improved magazine release buttons for firearms, which finger pad members are interchangeable.

The presently disclosed invention separately provides improved magazine release buttons for firearms, which finger pad members provide an increased surface area for a user's finger to contact.

The presently disclosed invention separately provides improved magazine release buttons for firearms, which finger pad members provide an increased surface area for a user's finger to contact.

The presently disclosed invention separately provides improved magazine release buttons for firearms, which finger pad member provides better purchase of a user's finger on the surface of the finger pad member.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
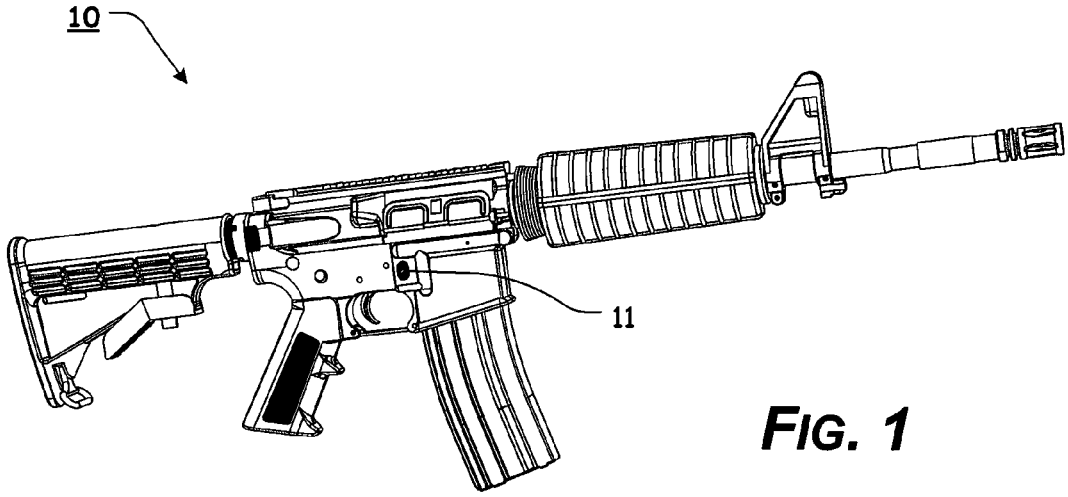
FIG. 1 PRIOR ART
FIG. 1 illustrates a perspective view of certain components of an AR-15 style firearm.
Figure 2:
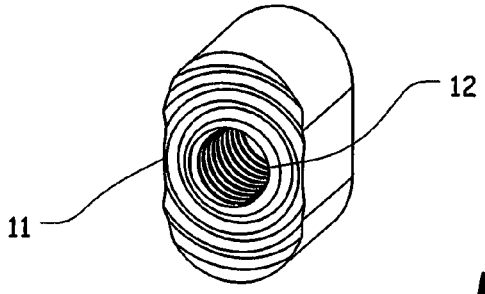
FIG. 2 PRIOR ART
FIG. 2 illustrates a more detailed view of a known magazine release button for an AR-15 style firearm.
Figure 3:
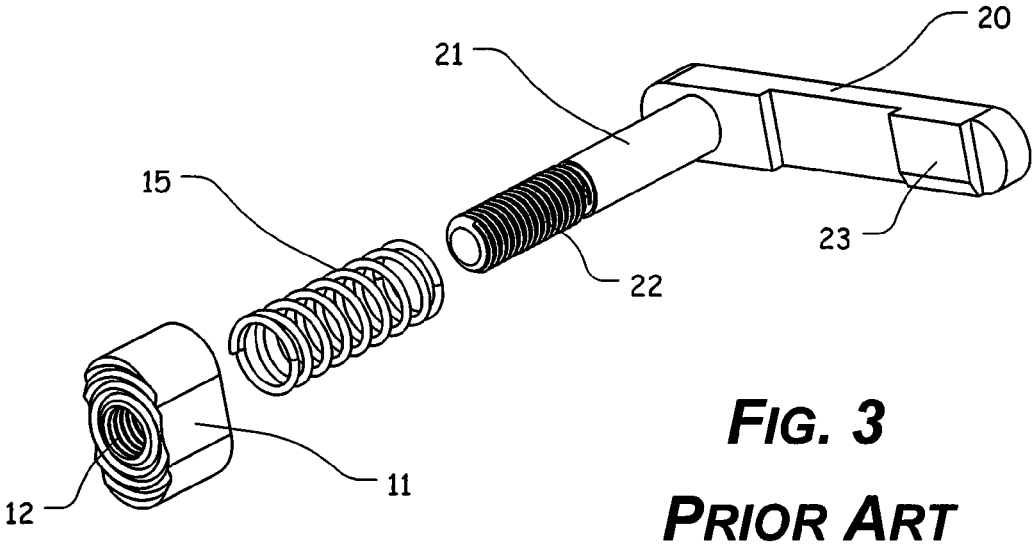
FIG. 3 PRIOR ART
FIG. 3 illustrates a more detailed, exploded view of the components of the known magazine release and magazine release button.
Figure 4:
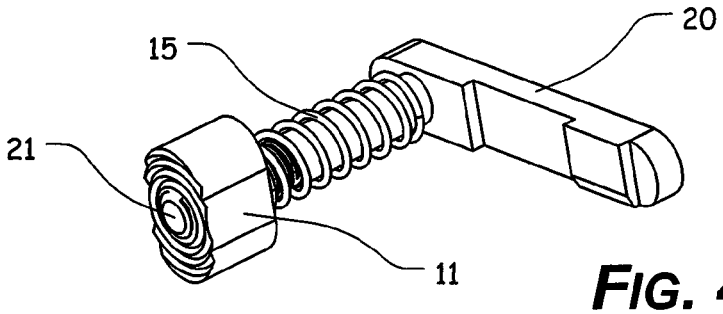
FIG. 4 PRIOR ART
FIG. 4 illustrates a more detailed, assembled view of the components of the known magazine release and magazine release button.
Figure 5:
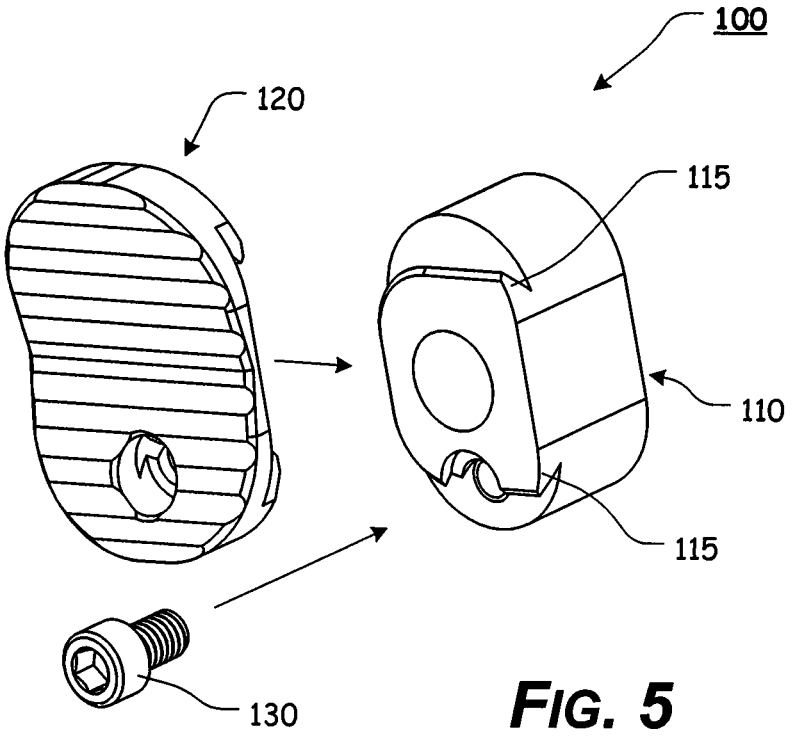
FIG. 5 illustrates an exploded view showing the components of a first exemplary embodiment of an enhanced magazine release button assembly, according to this invention.
Figure 6:
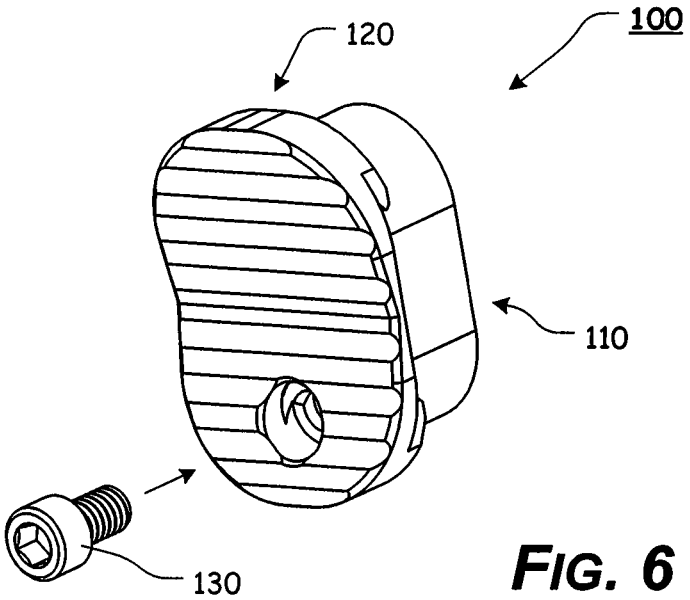
FIG. 6 illustrates a partially exploded view showing the components of a first exemplary embodiment of an enhanced magazine release button assembly, according to this invention.
Figure 7:
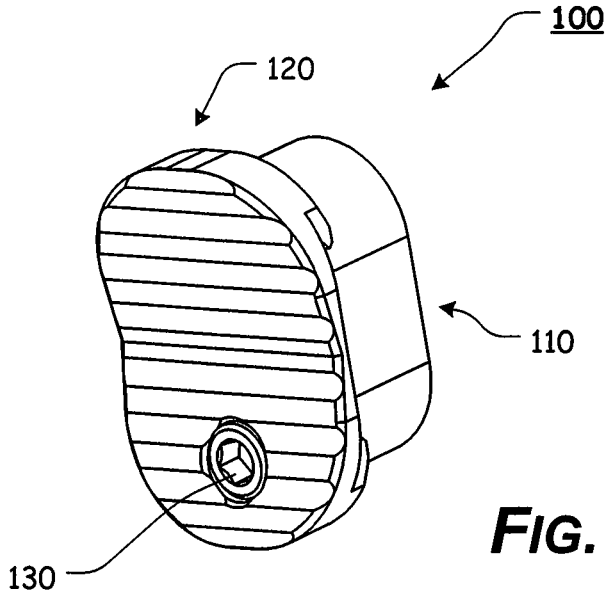
FIG. 7 illustrates a perspective view of a first exemplary embodiment of an enhanced magazine release button assembly, according to this invention.
Figure 8:
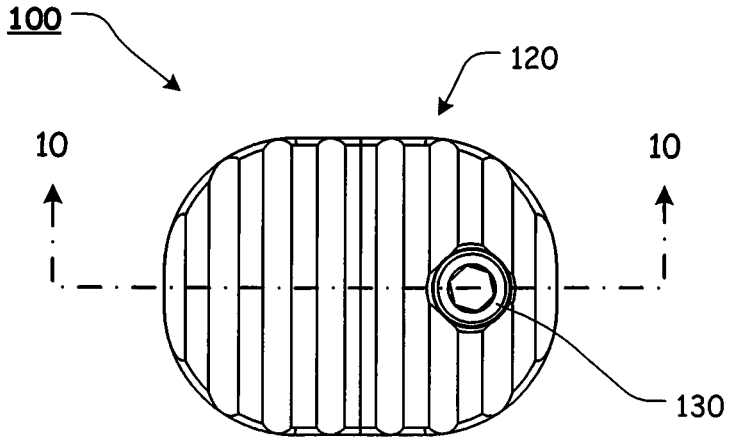
FIG. 8 illustrates a top view of a first exemplary embodiment of an enhanced magazine release button assembly, according to this invention.
Figure 9:
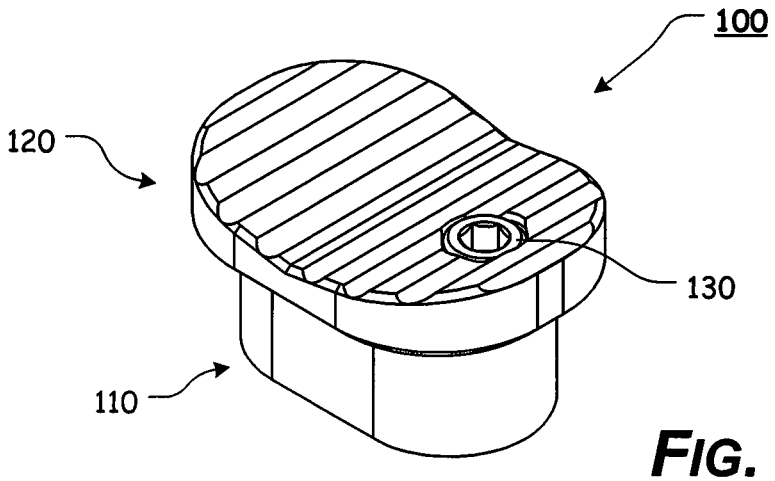
FIG. 9 illustrates a first, upper, perspective view of a first exemplary embodiment of an enhanced magazine release button assembly, according to this invention.
Figure 10:
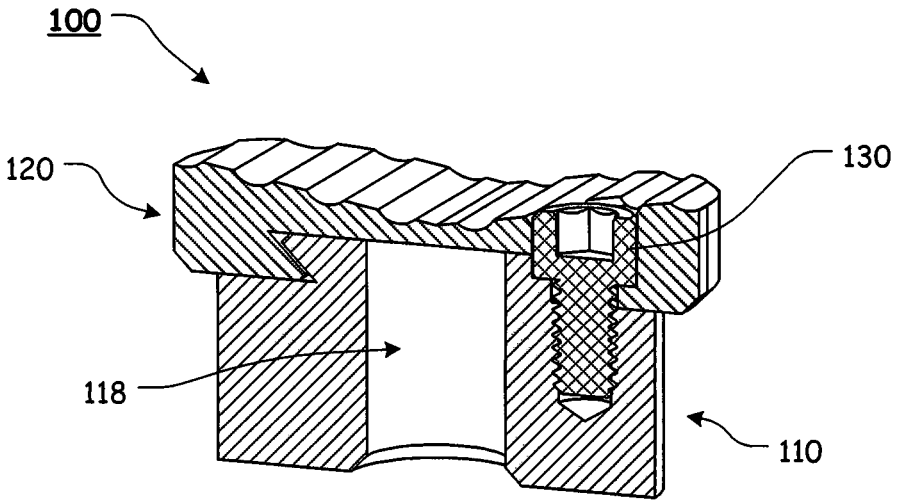
FIG. 10 illustrates a cross-sectional view, taken along line 10-10 of FIG. 8, of a first exemplary embodiment of an enhanced magazine release button assembly, according to this invention.
Figure 11:
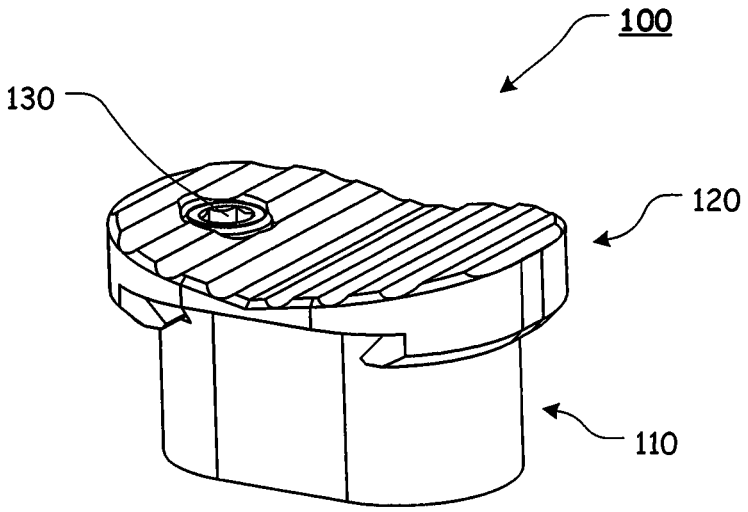
FIG. 11 illustrates a second, upper, perspective view of a first exemplary embodiment of an enhanced magazine release button assembly, according to this invention.
Figure 12:
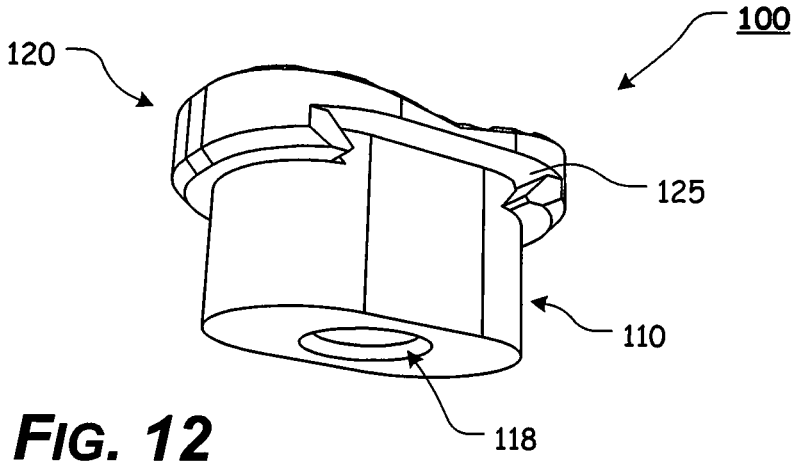
FIG. 12 illustrates a first, lower, perspective view of a first exemplary embodiment of an enhanced magazine release button assembly, according to this invention.
Figure 13:
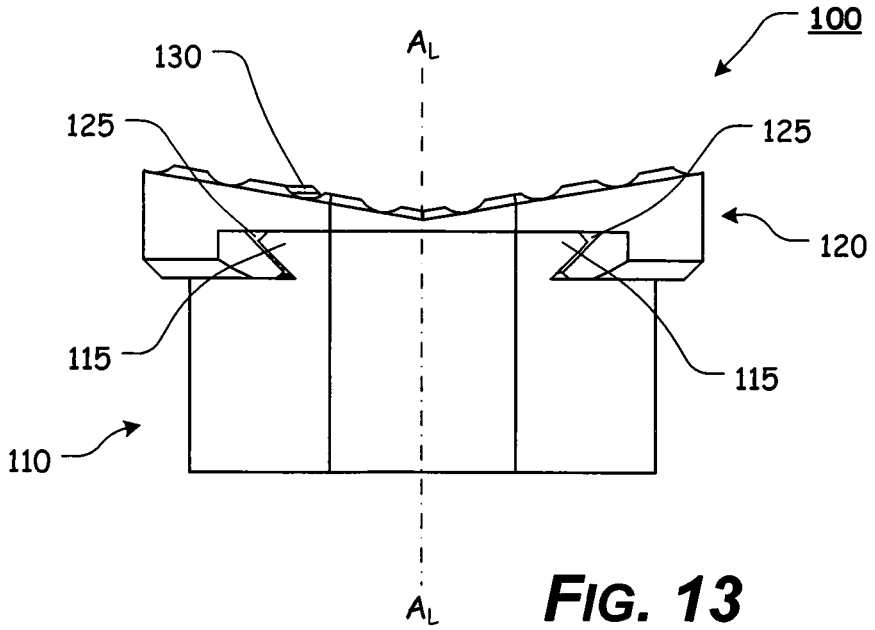
FIG. 13 illustrates a front view of a first exemplary embodiment of an enhanced magazine release button assembly, according to this invention.
Figure 14:
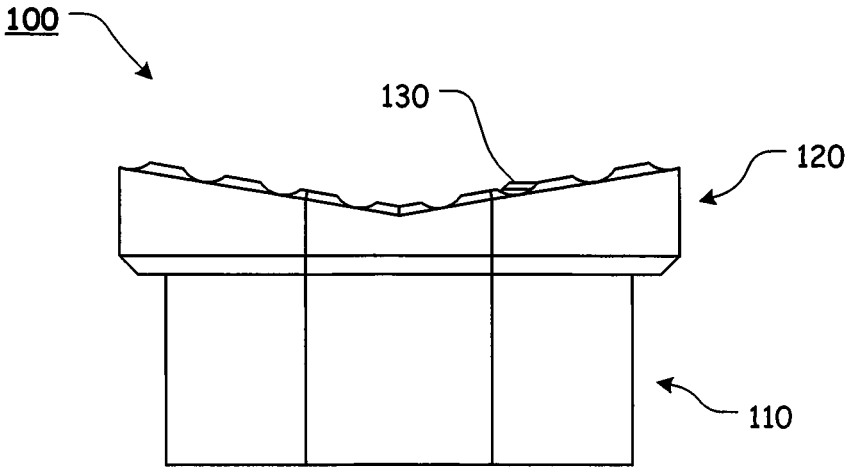
FIG. 14 illustrates a rear view of a first exemplary embodiment of an enhanced magazine release button assembly, according to this invention.
Figure 15:
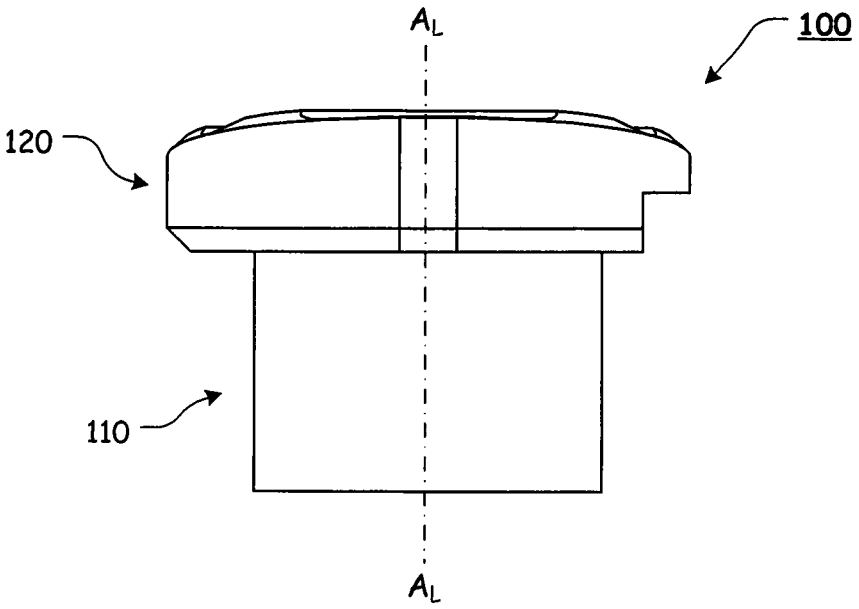
FIG. 15 illustrates a left side view of a first exemplary embodiment of an enhanced magazine release button assembly, according to this invention.
Figure 16:
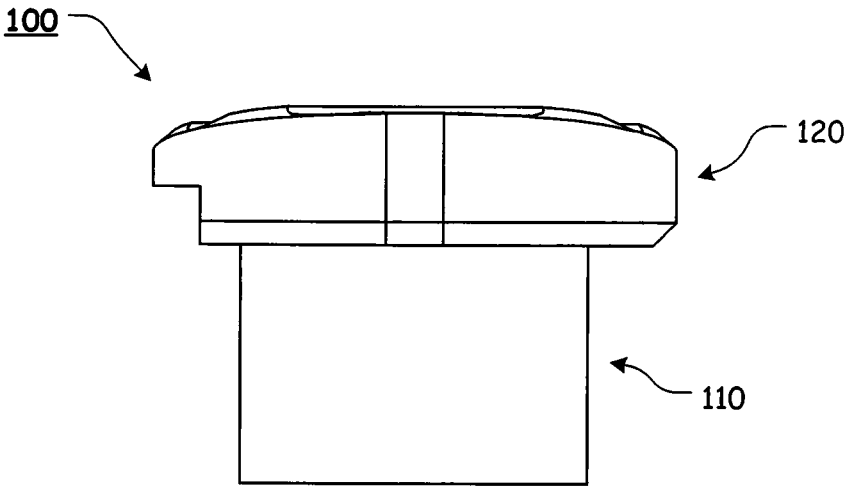
FIG. 16 illustrates a right side view of a first exemplary embodiment of an enhanced magazine release button assembly, according to this invention.
Figure 17:
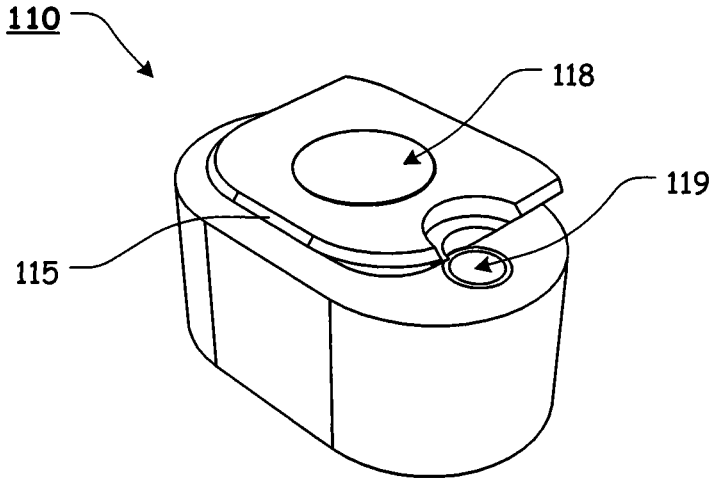
FIG. 17 illustrates a first, upper, perspective view of an enhanced magazine release button assembly, according to this invention.
Figure 18:
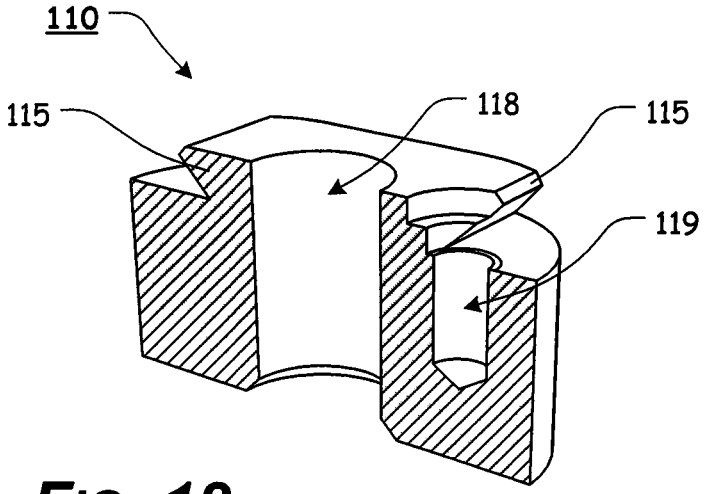
FIG. 18 illustrates a cross-sectional view, taken along line 18-18 of FIG. 21, of an enhanced magazine release button assembly, according to this invention.
Figure 19:
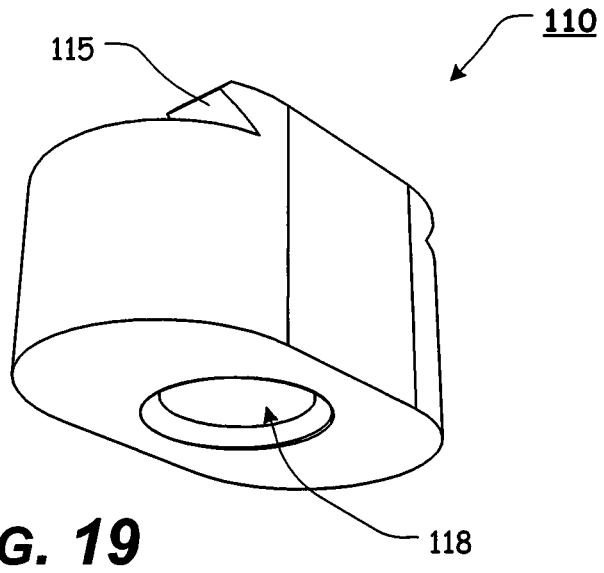
FIG. 19 illustrates a first, lower, perspective view of an enhanced magazine release button assembly, according to this invention.
Figure 20:
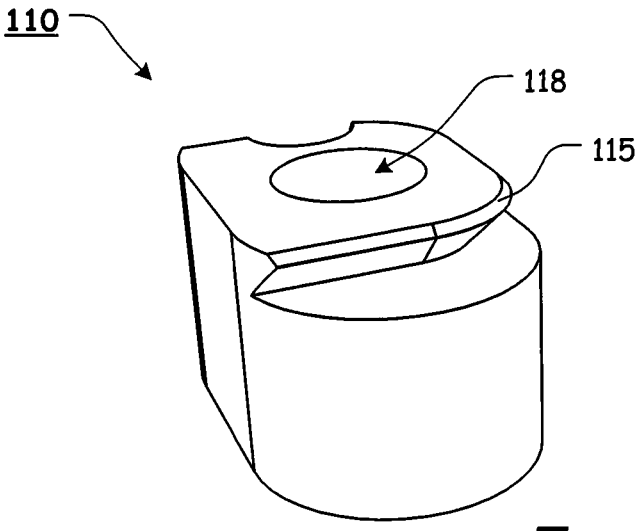
FIG. 20 illustrates a second, upper, perspective view of an enhanced magazine release button assembly, according to this invention.
Figure 21:
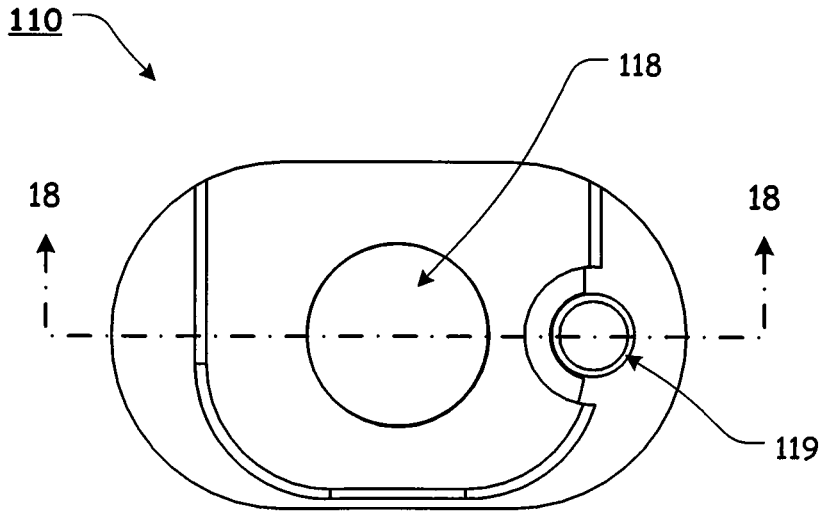
FIG. 21 illustrates a top view of an enhanced magazine release button assembly, according to this invention.
Figure 22:
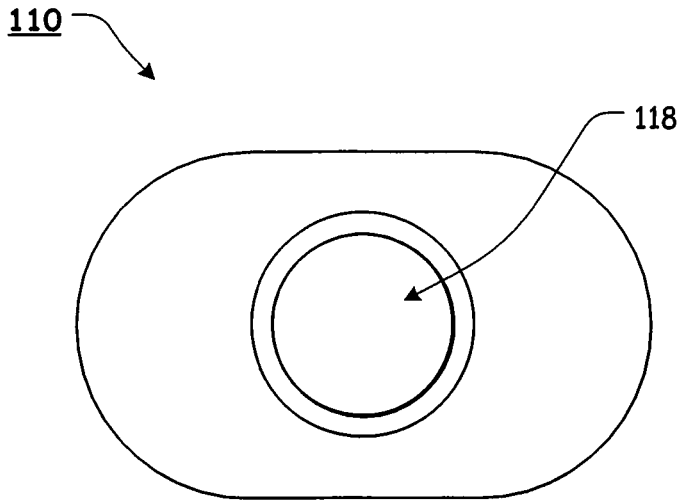
FIG. 22 illustrates a bottom view of an enhanced magazine release button assembly, according to this invention.
Figure 23:
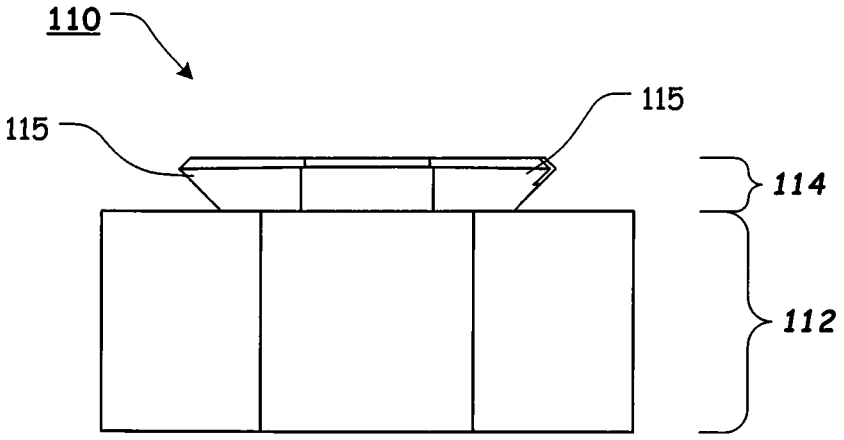
FIG. 23 illustrates a front side view of an enhanced magazine release button assembly, according to this invention.
Figure 24:
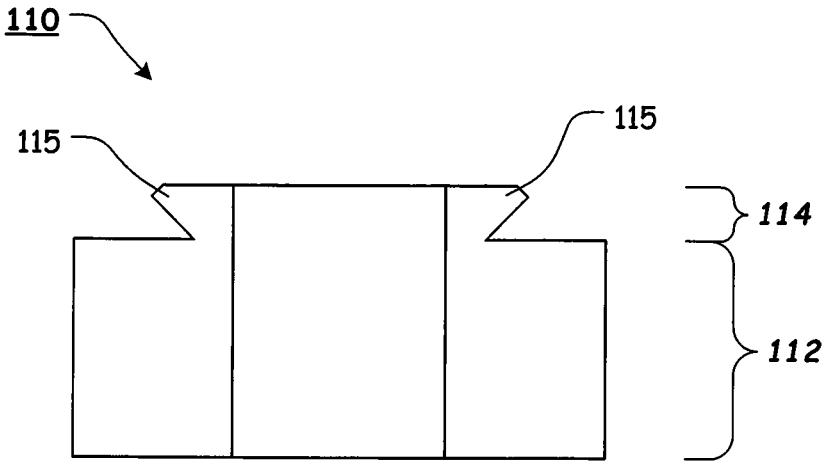
FIG. 24 illustrates a rear side view of an enhanced magazine release button assembly, according to this invention.
Figure 25:
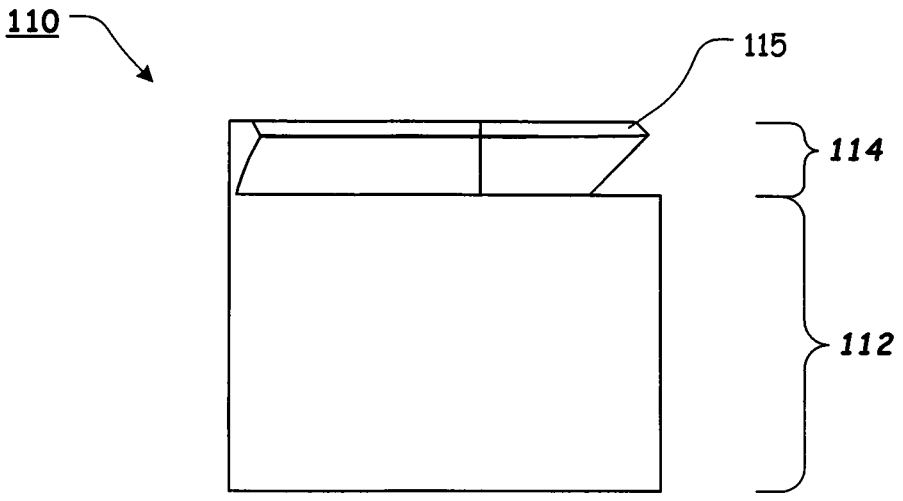
FIG. 25 illustrates a right side view of an enhanced magazine release button assembly, according to this invention.
Figure 26:
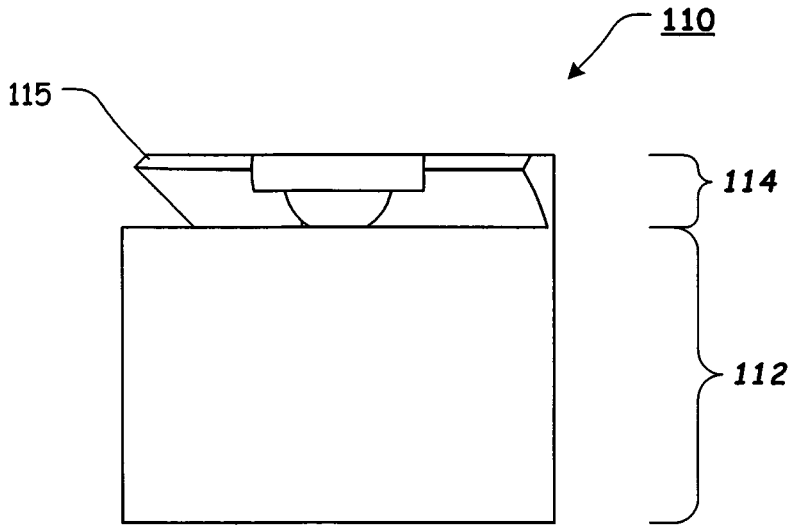
FIG. 26 illustrates a left side view of an enhanced magazine release button assembly, according to this invention.
Figure 27:
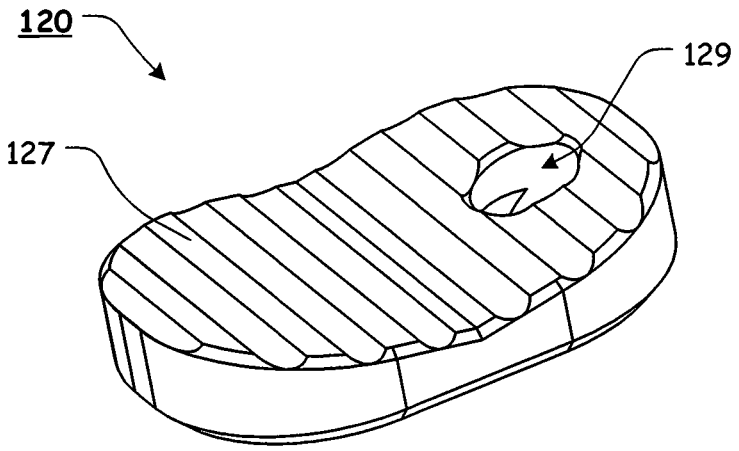
FIG. 27 illustrates a first, upper, perspective view of an enhanced magazine release button assembly finger pad, according to this invention.
Figure 28:
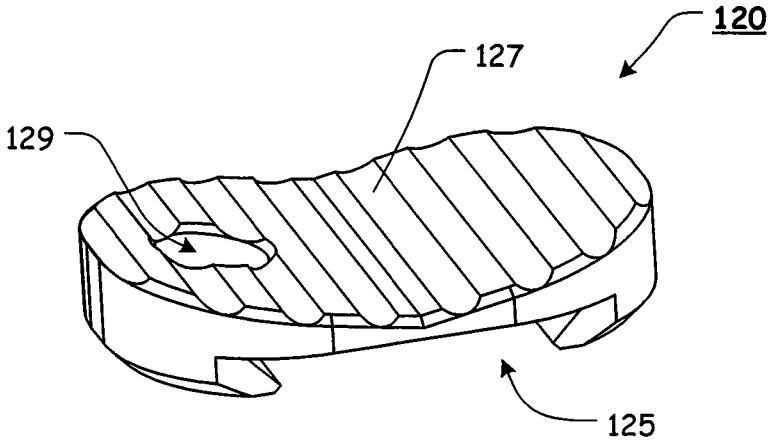
FIG. 28 illustrates a second, upper, perspective view of an enhanced magazine release button assembly finger pad, according to this invention.
Figure 29:
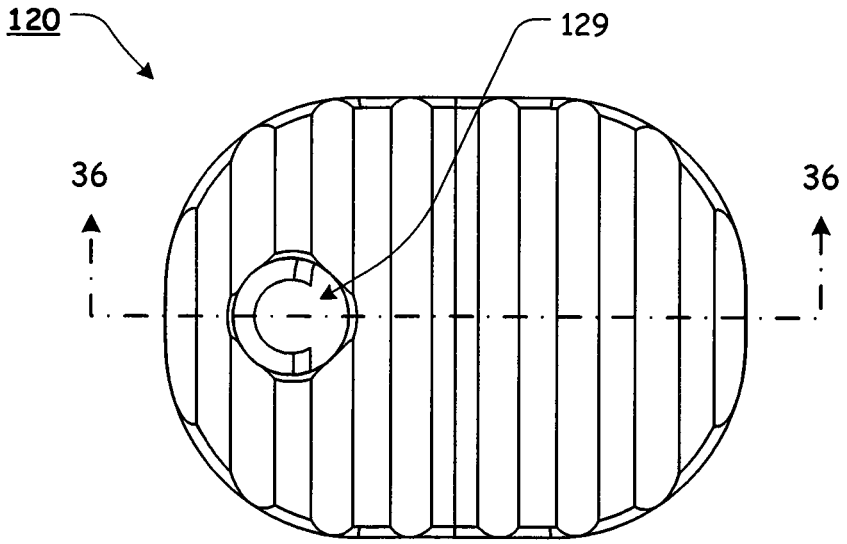
FIG. 29 illustrates a top view of an enhanced magazine release button assembly finger pad, according to this invention.
Figure 30:
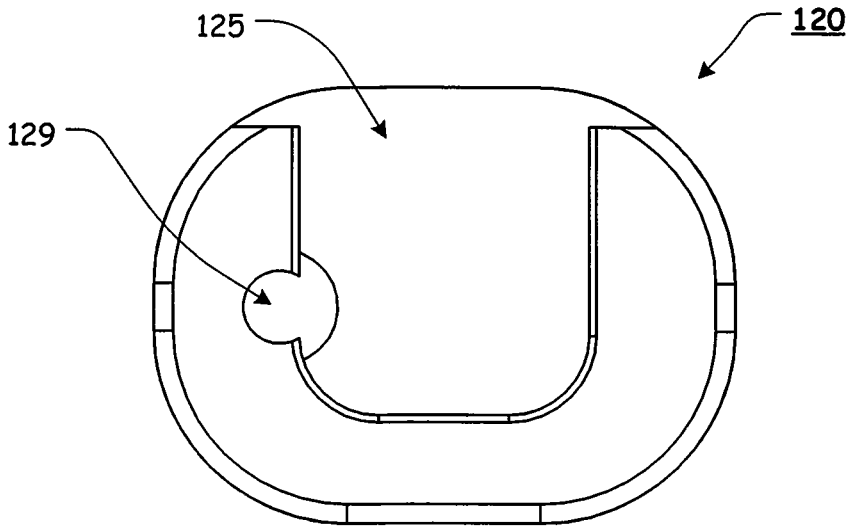
FIG. 30 illustrates a bottom view of an enhanced magazine release button assembly finger pad, according to this invention.
Figure 31:
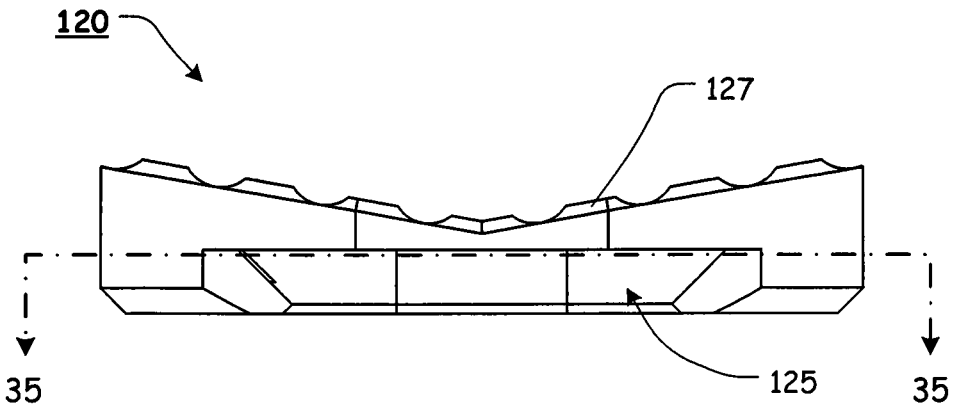
FIG. 31 illustrates a front side view of an enhanced magazine release button assembly finger pad, according to this invention.
Figure 32:
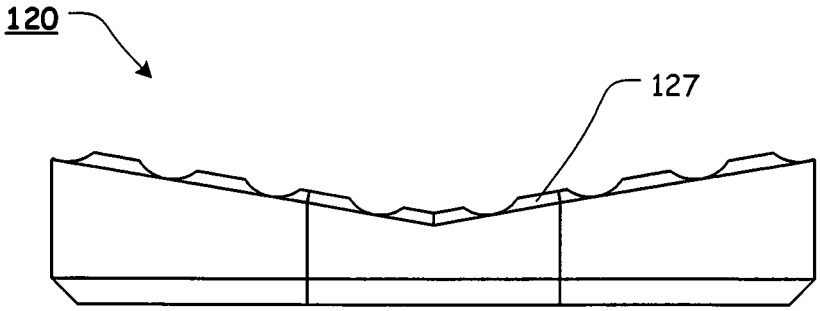
FIG. 32 illustrates a rear side view of an enhanced magazine release button assembly finger pad, according to this invention.
Figure 33:
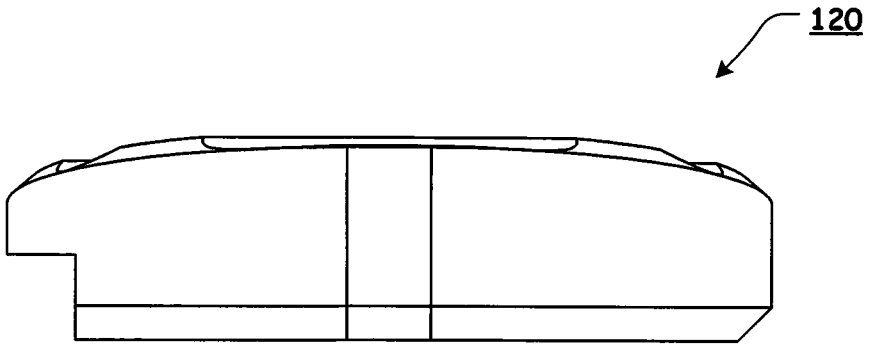
FIG. 33 illustrates a right side view of an enhanced magazine release button assembly finger pad, according to this invention.
Figure 34:
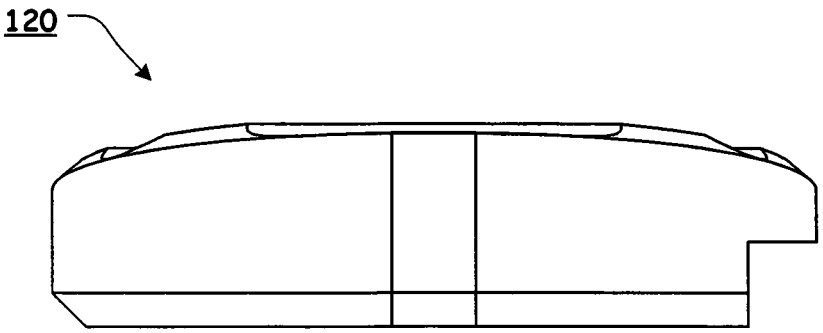
FIG. 34 illustrates a left side view of an enhanced magazine release button assembly finger pad, according to this invention.
Figure 35:
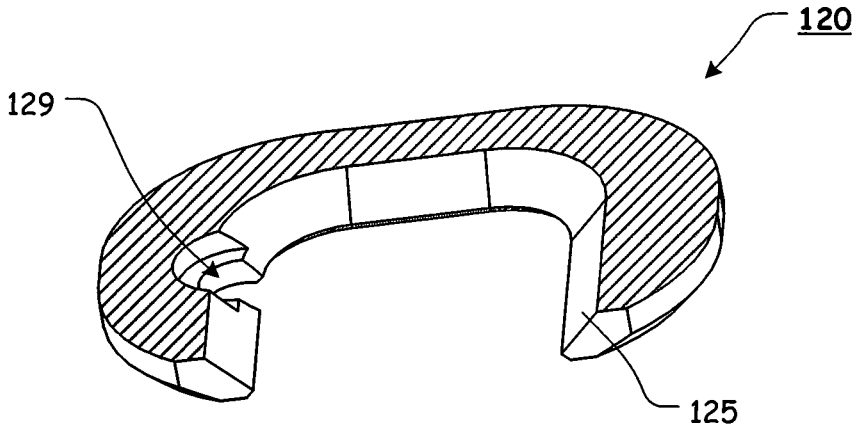
FIG. 35 illustrates a cross-sectional view, taken along line 35-35 of FIG. 31, of an enhanced magazine release button assembly finger pad, according to this invention.
Figure 36:
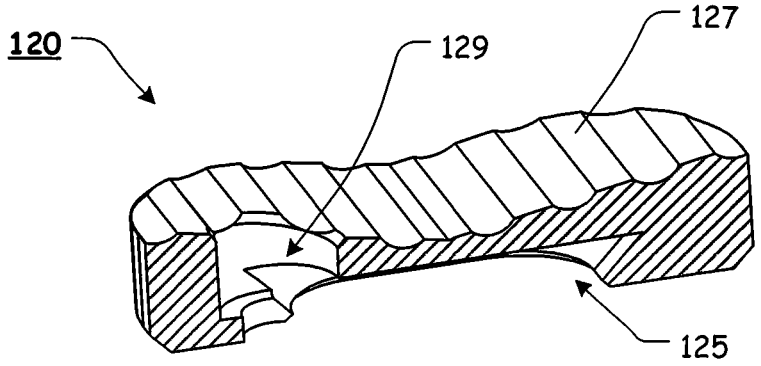
FIG. 36 illustrates a cross-sectional view, taken along line 36-36 of FIG. 29, of an enhanced magazine release button assembly finger pad, according to this invention.

For simplicity and clarification, the design factors and operating principles of the enhanced magazine release button assembly according to this invention are explained with reference to various exemplary embodiments of an enhanced magazine release button assembly according to this invention. The basic explanation of the design factors and operating principles of the enhanced magazine release button assembly is applicable for the understanding, design, and operation of the enhanced magazine release button assembly of this invention. It should be appreciated that the enhanced magazine release button assembly can be adapted to many applications where an enhanced magazine release button assembly or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "magazine release button assembly", "magazine release button", and "firearm" are used for basic explanation and understanding of the operation of the systems, methods, and apparatuses of this invention. Therefore, the terms "magazine release button assembly", "magazine release button", and "firearm" are not to be construed as limiting the systems, methods, and apparatuses of this invention.

For simplicity and clarification, the enhanced magazine release button assembly of this invention will be described as being used in conjunction with a firearm, such as a rifle or carbine. However, it should be appreciated that these are merely exemplary embodiments of the enhanced magazine release button assembly and are not to be construed as limiting this invention. Thus, the enhanced magazine release button assembly of this invention may be utilized in conjunction with any firearm, object, or device.

Turning now to the drawing Figs., FIGS. 5-16 illustrate certain elements and/or aspects of a first exemplary embodiment of the enhanced magazine release button assembly, according to this invention. FIGS. 17-26 illustrate certain elements and/or aspects of a first exemplary embodiment of the enhanced magazine release button member, while FIGS. 27-36 illustrate certain elements and/or aspects of a first exemplary embodiment of the enhanced magazine release button assembly finger pad.

In illustrative, non-limiting embodiment(s) of this invention, as illustrated in FIGS. 5-36, the enhanced magazine release button assembly 100 comprises a button member 110 (having a main body portion 112 and a projection portion 114) and a finger pad member 120.

It should be appreciated that while the finger pad member 120 is illustrated as having a profile (when viewed from the top) of a rounded rectangle, the finger pad member 120 may have a rectangular, square, circular, elliptical, triangular, or any other desired geometric shape. Thus, the overall size, shape, and/or appearance of the finger pad member 120 is a design choice based upon the desired ornamental appearance and/or functionality of the finger pad member 120.

Figure 41:
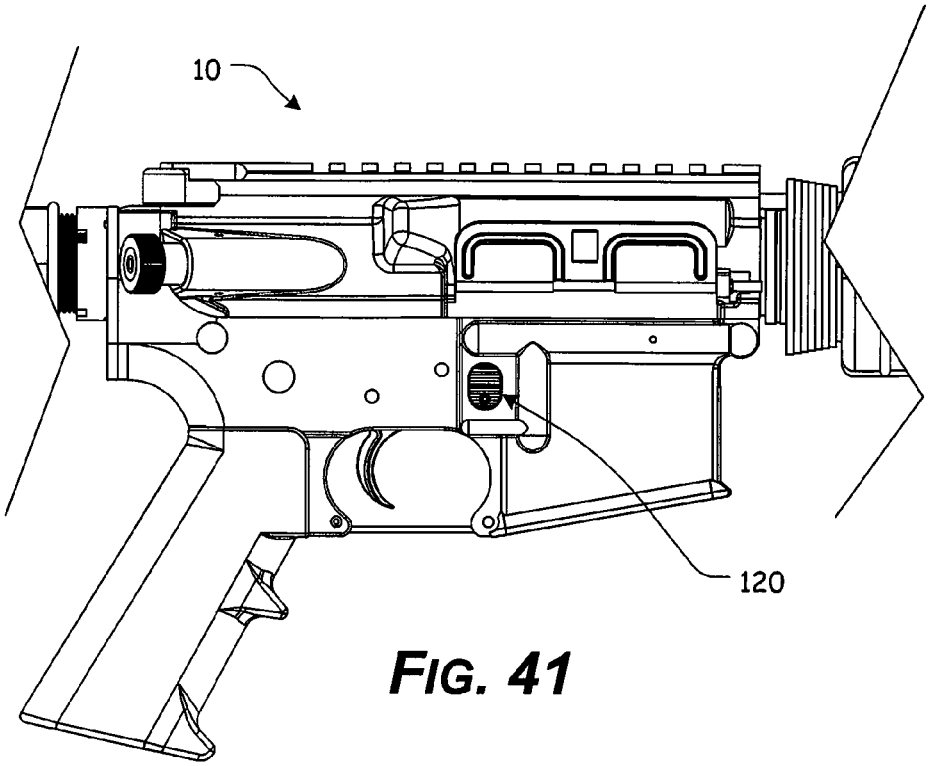
FIG. 41 illustrates a first exemplary embodiment of an enhanced magazine release button assembly installed in an exemplary rifle, according to this invention.

It should also be appreciated that at least a portion, if not all, of the finger pad member 120 has a larger lateral profile (height and width) than the lateral profile (height and width) of the button member 110. Thus, the size and shape of the finger pad member 120 allows a portion, if not all, of the finger pad member 120 to overhang button member 110 and, when installed, as illustrated in FIG. 41, the aperture formed in the firearm 10 for receiving the button member 110.

In the form of the present invention chosen for purposes of illustration, FIGS. 5-16 show various exploded, partially exploded, and assembled views of the enhanced magazine release button assembly 100, removed from a firearm. The enhanced magazine release button assembly 100 comprises at least some of a button member 110 and a finger pad member 120 secured to the projection portion 114 of the button member 110.

The button member 110 includes a primary threaded aperture 118 formed through the button member 110, parallel to a longitudinal axis $A_L$ of the button member 110. The primary threaded aperture 118 is formed so as to interact with a threaded portion of a magazine release, so that the button member 110 can be utilized in conjunction with a standard magazine release and installed in a fashion similar to that of a standard magazine release button.

The button member 110 also includes a secondary aperture 119 formed at least partially through the button member 110. The secondary aperture 119 is also formed parallel to a longitudinal axis $A_L$ of the button member 110, at a distance spaced apart from the primary threaded aperture 118. The secondary aperture 119 is formed so as to receive at least a portion of the fastener 130, when the fastener 130 is also used to secure the finger pad member 120 to the button member 110.

In various exemplary embodiments, as illustrated herein, the fastener 130 comprises a screw and the secondary aperture 119 comprises a threaded or at least partially threaded aperture. It should be appreciated that in other exemplary embodiments, the fastener 130 may comprise, for example, a roll pin and the secondary aperture 119 may comprise a non-threaded aperture size so as to receive and be frictionally engaged with the roll pin.

As further illustrated, the finger pad member 120 includes a recess 125 mateable with the projection 115 of the button member 110. Thus, when assembled, the finger pad member 120 is slidably secured to the end of the button member 110 via interaction of the projection 115 and the recess 125.

In various exemplary embodiments, as illustrated, the finger pad member 120 is optionally further secured to the projection portion 114 by suitable means, such as, for example, a fastener 130. The recessed design of the present invention provides a very solid attachment in which the fastener 130 simply prevents the finger pad member 120 from sliding along the recesses 125.

The button member 110 has a projection 115 formed in the projection portion 114 of the button member 110 and the finger pad member 120 is formed with recess 125, which mates with the projection 115. The projection 115 is a dovetail projection 115 and the recess 125 in the finger pad member 120 is a mating, dovetailed recess 125. More specifically, the illustrated projection 115 is a 3-sided dovetail projection 115 and the recess 125 in the finger pad member 120 is a 3-sided dovetailed recess 125. It should be appreciated that, in various exemplary embodiments, the projection 115 merely comprises a 2-sided dovetail projection, wherein the dovetail projections are on opposing sides relative to one another. In these embodiments, the recess 125 comprises a mating, 2-sided dovetail recess.

The finger pad member 120 further comprises a finger pad member aperture 129 formed therethrough. When the finger pad member 120 is secured to the button member 110, the finger pad member aperture 129 aligns with the secondary aperture 119, such that the fastener 130 can be secured through the finger pad member aperture 129 and the secondary aperture 119.

Figure 43:
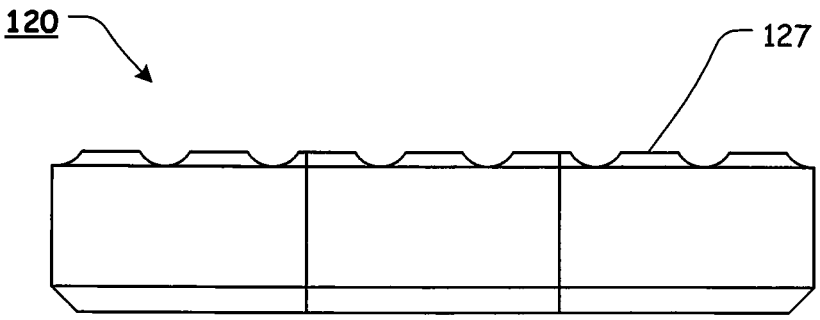
FIG. 43 illustrates a rear side view of an alternate embodiment of an enhanced magazine release button assembly finger pad, according to this invention.
Figure 44:
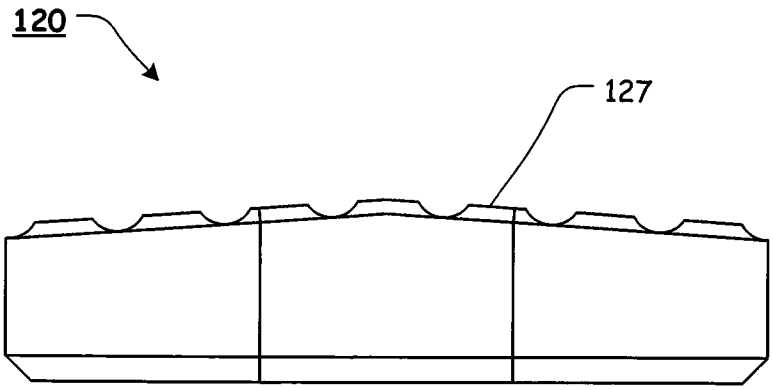
FIG. 44 illustrates a rear side view of yet another alternate embodiment of an enhanced magazine release button assembly finger pad, according to this invention.

In certain exemplary embodiments, the finger pad member 120 has a generally "U", "V", or surface 127 formed with a plurality of parallel grooves. These grooves, if included, serve to prevent the user's finger from slipping off the finger pad member 120. In various exemplary, nonlimiting embodiments, the finger pad member 120 comprises a textured surface 127. In certain exemplary embodiments, the surface 127 may be textured or non-textured and may be substantially concave. Alternatively, as illustrated in FIG. 43, the surface 127 may be textured or non-textured and may be substantially flat. In still other alternative embodiments, as illustrated in FIG. 44 the surface 127 may be textured or non-textured and may be substantially convex. Thus, it should be appreciated that the surface 127 may be textured or non-textured and may be substantially flat, concave, or convex, based upon the desired appearance and/or functionality of the finger pad member 120.

In various exemplary embodiments, the surface 127 is concave and the concavity of the surface 127 is parallel to the boar axis of the firearm. In this manner, the surface 127 acts to "self-center" the user's finger on the center of the finger pad member 120, thereby limiting lateral movement of the user's finger (up-and-down relative to the side wall of the firearm 10) and centering pressure from the user's finger on the center of the finger pad member 120.

In various exemplary, nonlimiting embodiments, the present invention optionally provides a plurality of interchangeable finger pad members 120 of different lengths, widths, thicknesses, configurations, profiles, and/or surface preparations to allow a user to select a finger pad member 120 that is most satisfactory to the shooter. It should be appreciated that, based upon the modularity of the present invention, finger pad members 120 may be exchanged or interchanged as desired, without having to remove the button member 110 from the firearm.

For example, a taller finger pad member may even extend above the ridge that typically extends from the receiver of the firearm to protect the magazine release button from inadvertent manipulation. This taller finger pad member 120 may be utilized by users competing in, for example, three gun matches who prefer to be able to "slap" the magazine release button and release the magazine without concern about having a low-profile magazine release button.

In various exemplary embodiments, various components of the enhanced magazine release button assembly 100 are substantially rigid and are formed of aluminum. Alternate materials of construction of the various components of the enhanced magazine release button assembly 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the enhanced magazine release button assembly 100 is a design choice based on the desired appearance and functionality of the enhanced magazine release button assembly 100.

It should be appreciated that certain elements of the enhanced magazine release button assembly 100 may be formed as an integral unit (such as, for example, the button member 110 and the finger pad member 120). Alternatively, suitable materials can be used and sections or elements made independently and attached or coupled together, such as by adhesives, welding, screws, rivets, pins, or other fasteners, to form the various elements of the enhanced magazine release button assembly 100.

It should also be understood that the overall size and shape of the enhanced magazine release button assembly 100 and the various portions thereof, the button member 110, and the finger pad members 120, is a design choice based upon the desired functionality and/or appearance of the enhanced magazine release button assembly 100.

It should also be appreciated that a more detailed explanation of the instructions regarding how to install the button member 110 of the enhanced magazine release button assembly 100 are not provided herein because such background information will be known to one of ordinary skill in the art. Therefore, it is believed that the level of description provided herein is sufficient to enable one of ordinary skill in the art to understand and practice the invention, as described.

In various exemplary embodiments, the enhanced magazine release button 100 comprises a button member 110, wherein the button member 110 includes a primary threaded aperture 118 formed through the button member 110 and a secondary aperture 119 formed at least partially through the button member 110, wherein the secondary aperture 119 is formed at a distance spaced apart from the primary threaded aperture 118, and wherein the button member 110 includes a projection 115 formed on an end of the button member 110; and a finger pad member 120, wherein the finger pad member 120 includes a recess 125 mateable with the projection 115 of the button member 110, wherein the finger pad member 120 further comprises a finger pad member aperture 129 formed therethrough, wherein when the finger pad member 120 is secured to the end of the button member 110, via interaction of the projection 115 and the recess 125, the finger pad member aperture 129 aligns with the secondary aperture 119, such that the finger pad member 120 may be further secured to the end of the button member 110 via a fastener 130 secured through the finger pad member aperture 129 and the secondary aperture 119.

In still other exemplary embodiments, the enhanced magazine release button 100 comprises a button member 110, wherein the button member 110 includes a primary threaded aperture 118 formed through the button member 110 and a secondary aperture 119 formed at least partially through the button member 110, wherein the secondary aperture 119 is formed at a distance spaced apart from the primary threaded aperture 118, and wherein the button member 110 includes a dovetail projection 115 formed on an end of the button member 110; and a finger pad member 120, wherein the finger pad member 120 includes a dovetail recess 125 mateable with the projection 115 of the button member 110, wherein the finger pad member 120 further comprises a finger pad member aperture 129 formed therethrough, wherein when the finger pad member 120 is secured to the end of the button member 110, via interaction of the dovetail projection 115 and the dovetail recess 125, the finger pad member aperture 129 aligns with the secondary aperture 119, such that the finger pad member 120 may be further secured to the end of the button member 110 via a fastener 130 secured through the finger pad member aperture 129 and the secondary aperture 119.

Figure 37:
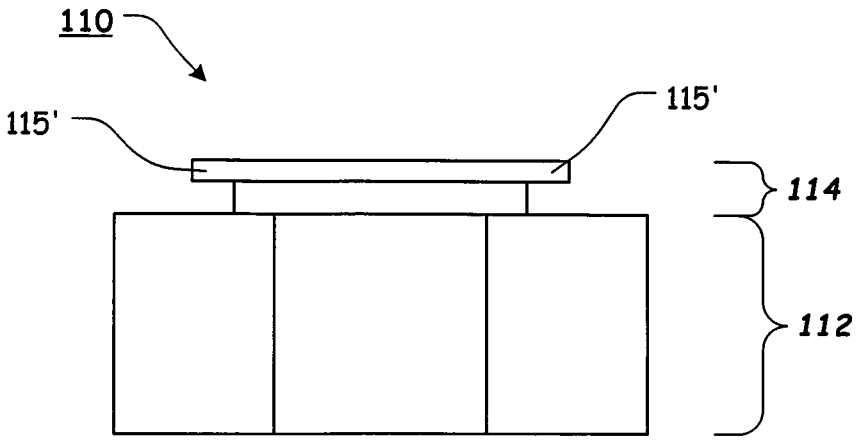
FIG. 37 illustrates a front side view of a second exemplary embodiment of an enhanced magazine release button assembly, according to this invention.
Figure 38:
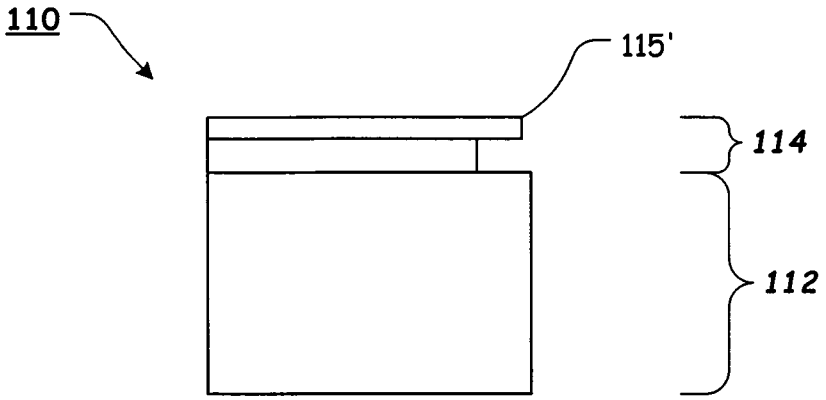
FIG. 38 illustrates a right side view of a second exemplary embodiment of an enhanced magazine release button assembly, according to this invention.
Figure 39:
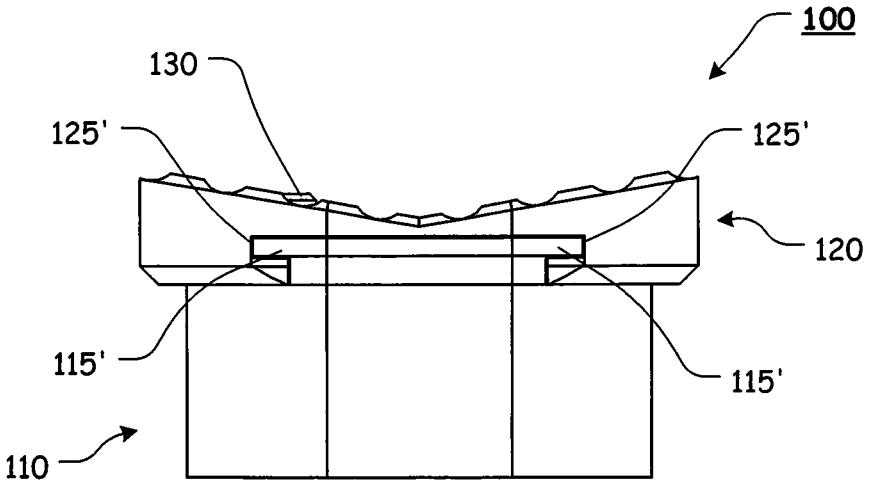
FIG. 39 illustrates a front view of a second exemplary embodiment of an enhanced magazine release button assembly, according to this invention.

FIGS. 37-39 illustrate a second exemplary embodiment of a button member 110 and a finger pad member 120. As illustrated, the button member 110 has a projection 115' formed in the projection portion 114 of the button member 110 and the finger pad member 120 is formed with recess 125', which mates with the projection 115'. The projection 115' is a "T" or square-shaped projection 115' and the recess 125' in the finger pad member 120 is a mating, "T" or square-shaped recess 125'. More specifically, the illustrated projection 115' is a 3-sided "T" or square-shaped projection 115' and the recess 125' in the finger pad member 120 is a 3-sided "T" or square-shaped recess 125'. It should be appreciated that, in various exemplary embodiments, the projection 115' merely comprises a 2-sided "T" or square-shaped projection, wherein the "T" or square-shaped projections are on opposing sides relative to one another. In these embodiments, the recess 125' comprises a mating, 2-sided "T" or square-shaped recess.

Figure 40:
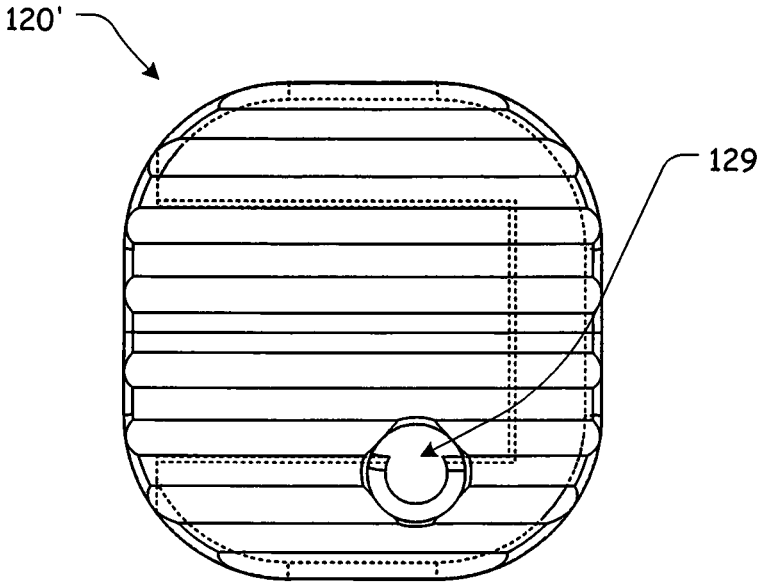
FIG. 40 illustrates a top view of a second exemplary embodiment of an enhanced magazine release button assembly finger pad, according to this invention.
Figure 42:
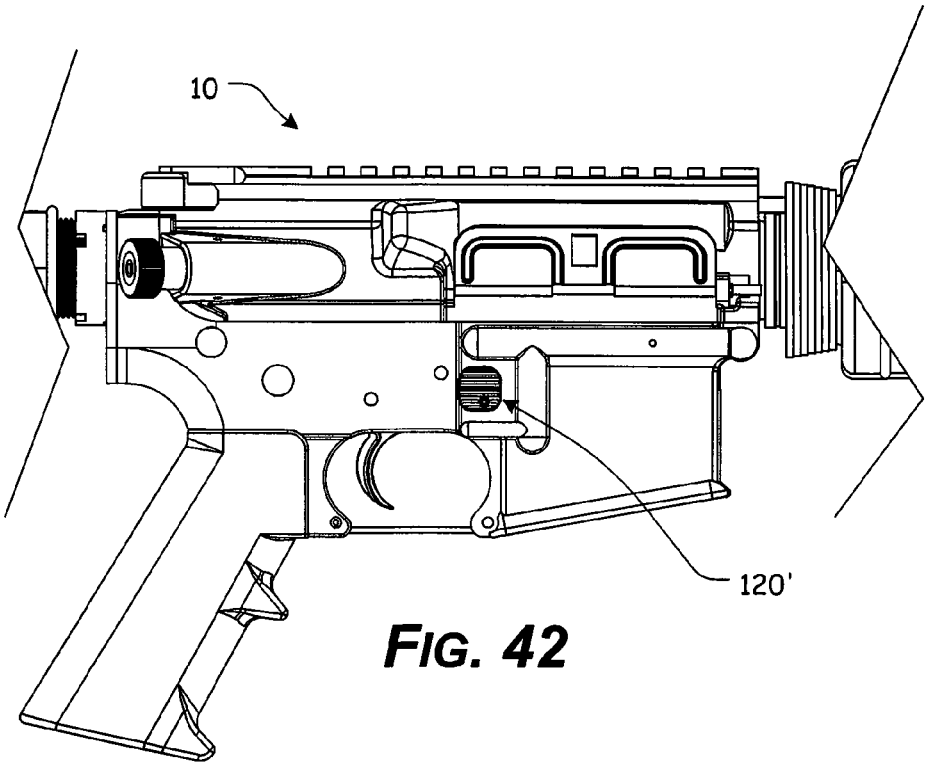
FIG. 42 illustrates a second exemplary embodiment of an enhanced magazine release button assembly installed in an exemplary rifle, according to this invention.

FIG. 40 illustrates a second exemplary embodiment of an interchangeable finger pad member 120'. As illustrated, the finger pad member 120' is elongated, such that when the finger pad member 120' is installed in the firearm 10, as illustrated in FIG. 42, the elongate portion of the finger pad member 120' extends rearward, toward the trigger guard of the firearm 10.

Having such as elongate, rearwardly extending portion of the finger pad member 120' provides an extended finger pad for users who want a more rearward biased finger pad. This is particularly helpful for people with shorter fingers, who have difficulty reaching and manipulating the standard magazine release button without changing their grip position on the firearm.

Because of the interlocking characteristics of the projection 115 or 115' and the recess 125 or 125', the tendency of the finger pad member 120 or 120' to rotate or cam is overcome. Because of the unique characteristics of the present invention, the tendency to rotate or cam and the torque created by such motion is overcome with or without use of the fastener 130.

Figure 45:
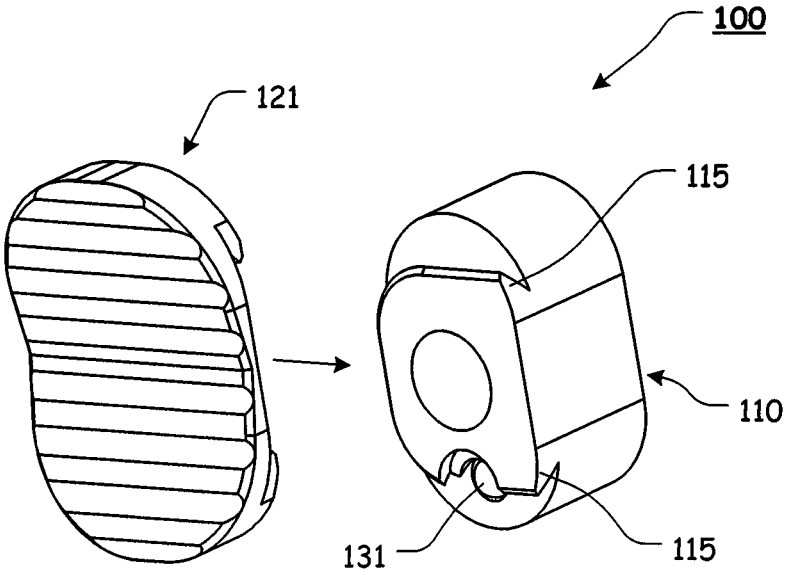
FIG. 45 illustrates an exploded view showing the components of an alternate exemplary embodiment of an enhanced magazine release button assembly, according to this invention.
Figure 46:
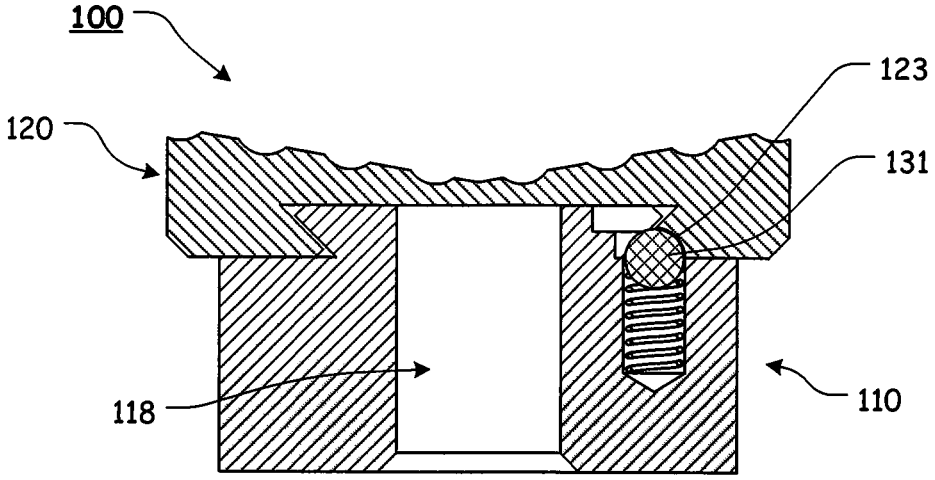
FIG. 46 illustrates cross-sectional view showing the components of the exemplary embodiment of the enhanced magazine release button assembly illustrated in FIG. 45, according to this invention.

FIGS. 45 and 46 illustrate an alternative exemplary embodiment of the enhanced magazine release button assembly, according to this invention. As illustrated, the secondary aperture 119 includes a captured, spring biased ball 131 and the finger pad member aperture 129 is replaced by a ball detent 123.

In these exemplary embodiments, with the finger pad member 120 is slated position, a portion of the spring biased ball 131 interacts with and is captured within a portion of the ball detent 123 to maintain the finger pad member 120 in a desired position relative to the button member 110. It should be understood that in these exemplary embodiments, the fastener 130 comprises the spring biased ball 131, which interacts with the ball detent 123. Thus, the finger pad member aperture 129 is removed and the face of the finger pad member 120 does not include an aperture formed therein.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An enhanced magazine release button assembly, comprising:

a button member, wherein said button member is shaped so as to resist rotational movement and allow at least some movement along a longitudinal axis of said button member, wherein said button member includes a projection extending from an end of said button member, and wherein said projection comprises a 3-sided dovetail projection; and a finger pad member, wherein said finger pad member includes a recess, wherein said recess comprises a 3-sided dovetail recess, wherein said 3-sided dovetail recess is mateable with said 3-sided dovetail projection of said button member, wherein said finger pad member is secured to said end of said button member via interaction of said 3-sided dovetail projection and said 3-sided dovetail recess.

2. The enhanced magazine release button assembly of claim 1, further comprising a primary threaded aperture formed through said button member, parallel to said longitudinal axis of said button member, wherein said primary threaded aperture is formed so as to interact with a threaded portion of a magazine release.

3. The enhanced magazine release button assembly of claim 2, further comprising a secondary aperture formed at least partially through said button member, wherein said secondary aperture is formed at a distance spaced apart from said primary threaded aperture, and wherein said secondary aperture is formed parallel to said longitudinal axis of said button member.

4. The enhanced magazine release button assembly of claim 3, wherein said finger pad member further comprises a finger pad member aperture formed therethrough, wherein when said finger pad member is secured to said button member, said finger pad member aperture aligns with said secondary aperture, such that a fastener can be secured through said finger pad member aperture and said secondary aperture.

5. The enhanced magazine release button assembly of claim 1, wherein interaction of said 3-sided dovetail projection and said 3-sided dovetail recess prevent movement of said finger pad member beyond a determined point relative to said button member.

6. The enhanced magazine release button assembly of claim 1, wherein said finger pad member is further secured to said end of said button member via a fastener.

7. The enhanced magazine release button assembly of claim 6, wherein said fastener comprises a spring biased ball and said secondary aperture comprises a ball detent.

8. The enhanced magazine release button assembly of claim 1, wherein said finger pad member comprises a substantially concave, flat, or convex surface.

9. The enhanced magazine release button assembly of claim 1, wherein a plurality of parallel grooves are formed on a surface of said finger pad member.

10. The enhanced magazine release button assembly of claim 1, wherein a plurality of interchangeable finger pad members are provided.

11. An enhanced magazine release button assembly, comprising:

a button member, wherein said button member is shaped so as to resist rotational movement and allow at least some movement along a longitudinal axis of said button member, wherein said button member includes a primary threaded aperture formed through said button member and a secondary aperture formed at least partially through said button member, wherein said secondary aperture is formed at a distance spaced apart from said primary threaded aperture, and wherein said button member includes a projection extending from an end of said button member; and a finger pad member, wherein said finger pad member includes a recess mateable with said projection of said button member, wherein said finger pad member further comprises a finger pad member aperture formed therethrough, wherein when said finger pad member is secured to said end of said button member, via interaction of said projection and said recess, said finger pad member aperture aligns with said secondary aperture, such that said finger pad member may be further secured to said end of said button member via a fastener secured through said finger pad member aperture and said secondary aperture;

wherein said projection comprises a 3-sided dovetail projection and said recess in said finger pad member comprises a 3-sided dovetailed recess.

12. The enhanced magazine release button assembly of claim 11, wherein said primary threaded aperture is formed so as to interact with a threaded portion of a magazine release.

13. The enhanced magazine release button assembly of claim 11, wherein said projection comprises a dovetail projection and said recess in said finger pad member comprises a dovetailed recess.

14. The enhanced magazine release button assembly of claim 11, wherein said fastener comprises a screw.

15. The enhanced magazine release button assembly of claim 11, wherein said finger pad member comprises a substantially concave surface.

16. The enhanced magazine release button assembly of claim 11, wherein said finger pad member comprises a substantially flat or convex surface.

17. An enhanced magazine release button assembly, comprising:

a button member, wherein said button member is shaped so as to resist rotational movement and allow at least some movement along a longitudinal axis of said button member, wherein said button member includes a primary threaded aperture formed through said button member and a secondary aperture formed at least partially through said button member, wherein said secondary aperture is formed at a distance spaced apart from said primary threaded aperture, wherein said button member includes a dovetail projection extending from an end of said button member, and wherein said projection comprises a 3-sided dovetail projection; and a finger pad member, wherein said finger pad member includes a dovetail recess, wherein said dovetail recess comprises a 3-sided dovetailed recess, wherein said dovetail recess is mateable with said projection of said button member, wherein said finger pad member further comprises a finger pad member aperture formed therethrough, wherein when said finger pad member is secured to said end of said button member, via interaction of said 3-sided dovetail projection and said 3-sided dovetail recess, said finger pad member aperture aligns with said secondary aperture, such that said finger pad member may be further secured to said end of said button member via a fastener secured through said finger pad member aperture and said secondary aperture.

18. The enhanced magazine release button assembly of claim 17, wherein said primary threaded aperture is formed so as to interact with a threaded portion of a magazine release.

19. The enhanced magazine release button assembly of claim 17, wherein said finger pad member comprises a substantially concave surface.

20. The enhanced magazine release button assembly of claim 17, wherein said finger pad member comprises a substantially flat or convex surface.

* * * * *